US007987830B2

(12) United States Patent
Kim

(10) Patent No.: US 7,987,830 B2
(45) Date of Patent: Aug. 2, 2011

(54) OIL SUPPLY STRUCTURE FOR CONTINUOUS VARIABLE VALVE TIMING APPARATUS AND CYLINDER HEAD EMPLOYING THE SAME

(75) Inventor: Kyounghee Kim, Ansan (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 634 days.

(21) Appl. No.: 12/117,588

(22) Filed: May 8, 2008

(65) Prior Publication Data

US 2009/0151672 A1 Jun. 18, 2009

(30) Foreign Application Priority Data

Dec. 14, 2007 (KR) ..... 10-2007-0131571

(51) Int. Cl.
*F01M 1/06* (2006.01)

(52) U.S. Cl. ..... 123/90.33; 123/90.15; 123/193.5

(58) Field of Classification Search ..... 123/90.33, 123/90.34, 90.15, 90.17, 193.3, 193.5, 90.12, 123/90.13

See application file for complete search history.

(56) References Cited

U.S. PATENT DOCUMENTS 6,032,629 A * 3/2000 Uchida ..... 123/90.34

FOREIGN PATENT DOCUMENTS

JP 11-303615 A 11/1999
KR 10-2006-0015006 A 2/2006

* cited by examiner

*Primary Examiner* — Ching Chang

(74) *Attorney, Agent, or Firm* — Morgan, Lewis & Bockius LLP

(57) ABSTRACT

An oil supply structure of a continuously variable valve timing apparatus includes: a first oil filter to receive and filter oil from a main gallery; a first oil control valve to receive oil from the first oil filter; a first continuously variable valve timing apparatus to receive oil from the first oil control valve; a second oil filter to receive and filter oil from the main gallery; a second oil control valve to receive oil from the second oil filter; a second continuously variable valve timing apparatus to receive oil from the second oil control valve; and an oil supply line in a cylinder head, that fluidly connects the main gallery, the oil filters, the oil control valves, and the continuously variable valve timing apparatuses. The cylinder head includes the oil supply line, and various holes for the components of the oil supply structure to be disposed therein.

5 Claims, 2 Drawing Sheets

OIL SUPPLY STRUCTURE FOR CONTINUOUS VARIABLE VALVE TIMING APPARATUS AND CYLINDER HEAD EMPLOYING THE SAME

CROSS-REFERENCE TO RELATED APPLICATION

This application claims priority to, and the benefit of, Korean Patent Application No. 10-2007-0131571, filed in the Korean Intellectual Property Office on Dec. 14, 2007, the entire contents of which are incorporated herein by reference.

BACKGROUND OF THE INVENTION (a) Field of the Invention

The present invention relates to an oil supply structure of a continuously variable valve timing (CVVT) apparatus, and a cylinder head employing such an oil supply structure.

(b) Description of the Related Art

Optimal operation of intake and exhaust valves depends on rotation speed of the engine. That is, optimal opening/closing timing, and optimal lift, of the valves depends on the rotation speed. A continuously variable valve timing (CVVT) apparatus enables different valve timings depending on the engine speed. Typically, a CVVT apparatus is operated by oil hydraulic pressure, and its precision can be improved by removing impurities from the oil.

The above information disclosed in this Background section is only for enhancement of understanding of the background of the invention and therefore it may contain information that does not form the prior art that is already known in this country to a person of ordinary skill in the art.

SUMMARY OF THE INVENTION

An oil supply structure of a continuously variable valve timing apparatus includes: a first oil filter to receive oil from a main gallery and to filter impurities therefrom; a first oil control valve to receive oil from the first oil filter; a first continuously variable valve timing apparatus to receive oil from the first oil control valve; a second oil filter to receive oil from the main gallery and to filter impurities therefrom; a second oil control valve to receive oil from the second oil filter; a second continuously variable valve timing apparatus to receive oil from the second oil control valve; and an oil supply line in a cylinder head, that fluidly connects the main gallery, the oil filters, the oil control valves, and the continuously variable valve timing apparatuses.

The oil supply line may include: a first oil passage to receive oil from the main gallery; a second oil passage connected with the first oil passage, to supply oil to the oil filters; a third oil passage that interconnects the first oil filter and the first oil control valve; a fourth oil passage that interconnects the first oil control valve and the first continuously variable valve timing apparatus; a fifth oil passage that interconnects the second oil filter and the second oil control valve; and a sixth oil passage that interconnects the second oil control valve and the second continuously variable valve timing apparatus.

The first oil filter, the first oil control valve, and the first continuously variable valve timing apparatus may be disposed at an intake side of the cylinder head; and the second oil filter, the second oil control valve, and the second continuously variable valve timing apparatus may be disposed at an exhaust side of the cylinder head.

The oil supply line may also include a seventh oil passage that interconnects the second oil passage and a timing chain tensioner. The seventh oil passage may be adjacent to the second (exhaust side) oil filter.

A cylinder head includes: a first oil filter hole for receiving a first oil filter; a first oil control valve hole for receiving a first oil control valve; a second oil filter hole for receiving a second oil filter; a second oil control valve hole for receiving a second oil control valve; a first oil passage that is connected with a main gallery; a second oil passage that interconnects the first oil passage to the oil filter holes; a third oil passage that interconnects the first oil filter hole and the first oil control valve hole; a fourth oil passage that interconnects the first oil control valve hole and a first continuously variable valve timing apparatus; a fifth oil passage that interconnects the second oil filter hole and the second oil control valve hole; and a sixth oil passage that interconnects the second oil control valve hole and a second continuously variable valve timing apparatus.

The cylinder head may also include a seventh oil passage that interconnects the second oil passage to a timing chain tensioner.

DETAILED DESCRIPTION OF PREFERRED EMBODIMENTS

An exemplary embodiment of the present invention will hereinafter be described in detail with reference to the accompanying drawings.

Figure 1:
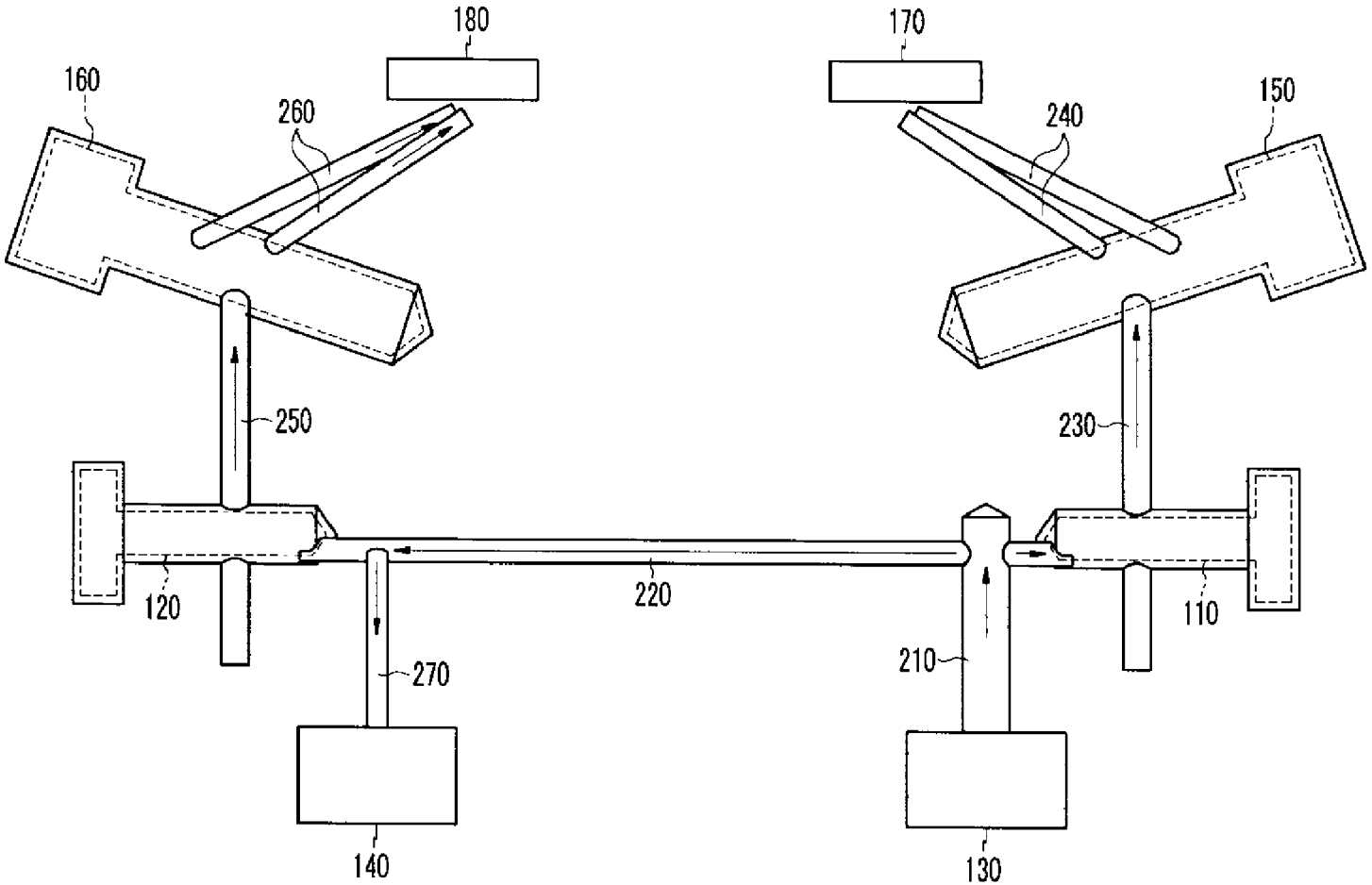
FIG. 1 shows an oil supply structure of a CVVT apparatus according to an exemplary embodiment of the present invention.

Referring to FIG. 1, an oil supply structure of a CVVT apparatus according to an exemplary embodiment of the present invention includes: a first oil filter 110 that receives oil from a main gallery 130 and filters impurities therefrom; a first oil control valve (OCV) 150 that receives oil from the first oil filter 110; a first CVVT apparatus 170 that receives oil from the first OCV 150; a second oil filter 120 that receives oil from the main gallery 130 and filters impurities therefrom; a second OCV 160 that receives oil from the second oil filter 120; and a second CVVT apparatus 180 that receives oil from the second OCV 160.

Figure 2:
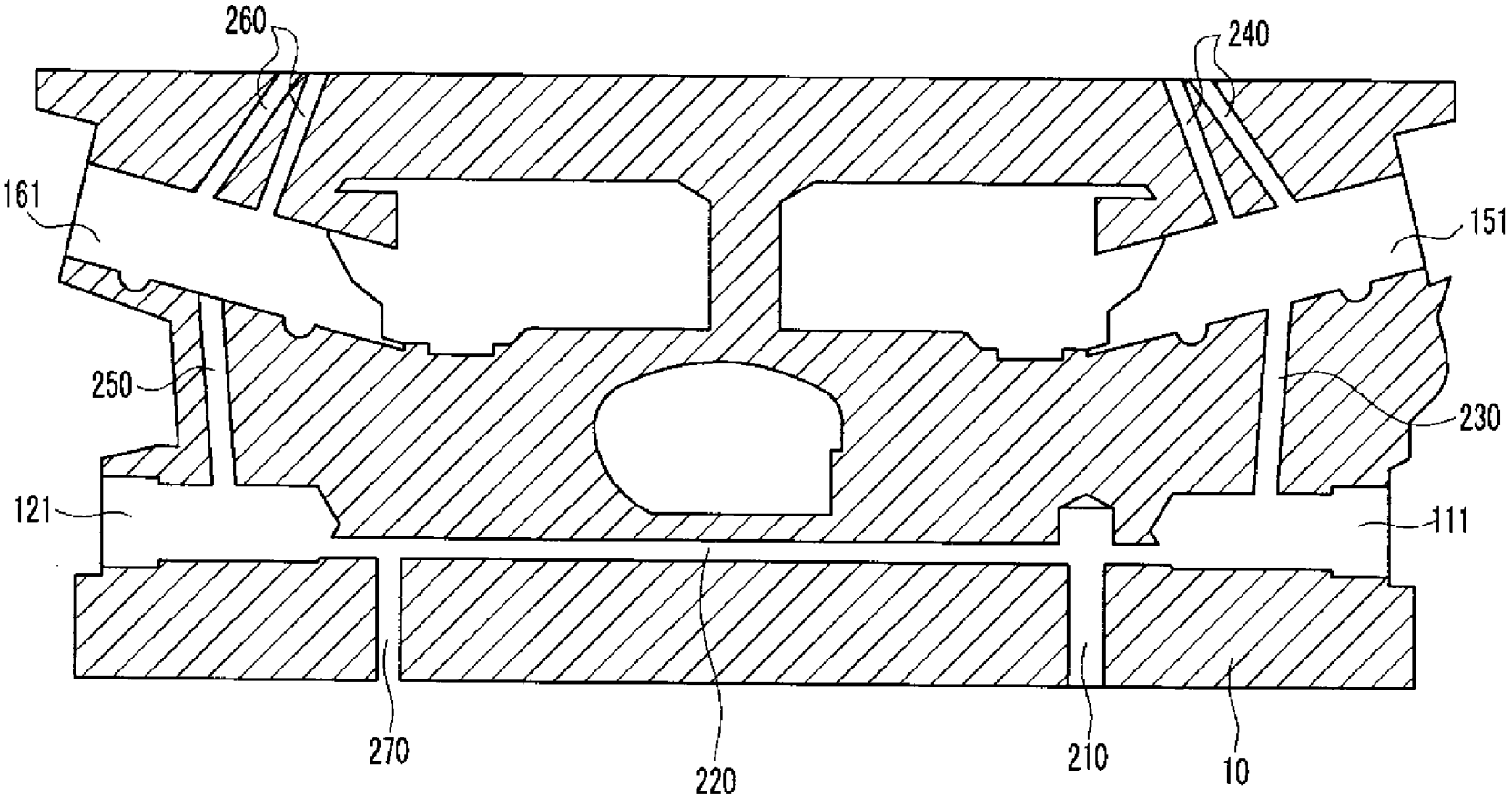
FIG. 2 is a cross-sectional view of a cylinder head employing an oil supply structure of a CVVT apparatus according to an exemplary embodiment of the present invention.

Referring also to FIG. 2, an oil supply line 210, 220, 230, 240, 250, 260, 270 in a cylinder head 10 fluidly connects the main gallery 130; the oil filters 110, 120; the OCVs 150, 160; and the CVVT apparatus 170, 180.

The oil supply line includes: a first oil passage 210 that receives pressurized oil from the main gallery 130; a second oil passage 220 that supplies oil from the first oil passage 210 to the oil filters 110, 120; a third oil passage 230 that interconnects the first oil filter 110 and the first OCV 150; a fourth oil passage 240 that interconnects the first OCV 150 and the first CVVT apparatus 170; a fifth oil passage 250 that interconnects the second oil filter 120 and the second OCV 160; a sixth oil passage 260 that interconnects the second OCV 160 and the second CVVT apparatus 180; and a seventh oil passage 270 that supplies oil from the second oil passage 220 to a timing chain tensioner 140. The seventh oil passage 270 may be adjacent to the second oil filter 120.

The first oil filter 110 may be an intake side oil filter. The first OCV 150 may be an intake side OCV. The first CVVT apparatus 170 may be an intake side CVVT apparatus. The second oil filter 120 may be an exhaust side oil filter. The second OCV 160 may be an exhaust side oil filter. The second CVVT apparatus 180 may be an exhaust side CVVT apparatus.

Impurities are well filtered by this exemplary oil supply structure, providing a precise CVVT apparatus. In addition, the seventh oil line 270 for supplying oil to the timing chain tensioner 140 may be adjacent to the exhaust side oil filter 120, obviating the need for a complicated process of forming a hole that fully crosses the cylinder block and plugging an end of the hole, as is typically employed.

Referring to FIG. 2, a cylinder head 10 according to an exemplary embodiment of the present invention includes: an intake side oil filter hole 111 for receiving the intake side oil filter 110; an intake side OCV hole 151 for receiving the intake side OCV 150; an exhaust side oil filter hole 121 for receiving the exhaust side oil filter 120; an exhaust side OCV hole 161 for receiving the exhaust side OCV 160; the first oil passage 210 that is connected with the main gallery 130; the second oil passage 220 that interconnects the first oil passage 210, the intake side oil filter hole 111, and the exhaust side oil filter hole 121; the third oil passage 230 that interconnects the intake side oil filter hole 111 and the intake side OCV hole 151; the fourth oil passage 240 that interconnects the intake side OCV hole 151 and the intake side CVVT apparatus 170; the fifth oil passage 250 that interconnects the exhaust side oil filter hole 121 and the exhaust side OCV hole 161; the sixth oil passage 260 that interconnects the exhaust side OCV hole 161 and the exhaust side CVVT apparatus 180; and the seventh oil passage 270 that supplies oil from the second oil passage 220 to the timing chain tensioner 140.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. An oil supply structure of a continuously variable valve timing apparatus, comprising:

a first oil filter configured to receive oil from a main gallery and filter impurities therefrom;

a first oil control valve configured to receive oil from the first oil filter;

a first continuously variable valve timing apparatus configured to receive oil from the first oil control valve;

a second oil filter configured to receive oil from the main gallery and filter impurities therefrom;

a second oil control valve configured to receive oil from the second oil filter;

a second continuously variable valve timing apparatus configured to receive oil from the second oil control valve; and an oil supply line disposed in a cylinder head, that fluidly connects the main gallery, the first and second oil filters, the first and second oil control valves, and the first and second continuously variable valve timing apparatuses;

wherein the oil supply line comprises:

a first oil passage configured to receive oil from the main gallery;

a second oil passage that is connected with the first oil passage and configured to supply oil to the first and second oil filters;

a third oil passage that interconnects the first oil filter and the first oil control valve;

a fourth oil passage that interconnects the first oil control valve and the first continuously variable valve timing apparatus;

a fifth oil passage that interconnects the second oil filter and the second oil control valve; and a sixth oil passage that interconnects the second oil control valve and the second continuously variable valve timing apparatus.

2. The oil supply structure of claim 1, wherein the oil supply line further comprises a seventh oil passage that interconnects the second oil passage and a timing chain tensioner.

3. The oil supply structure of claim 2, wherein the first oil filter, the first oil control valve, and the first continuously variable valve timing apparatus are disposed at an intake side of the cylinder head; and the second oil filter, the second oil control valve, and the second continuously variable valve timing apparatus are disposed at an exhaust side of the cylinder head; and wherein the seventh oil passage is adjacent to the second oil filter.

4. A cylinder head, comprising:

a first oil filter hole for receiving a first oil filter;

a first oil control valve hole for receiving a first oil control valve;

a second oil filter hole for receiving a second oil filter;

a second oil control valve hole for receiving a second oil control valve;

a first oil passage that is connected with a main gallery;

a second oil passage that interconnects the first oil passage to the oil filter holes;

a third oil passage that interconnects the first oil filter hole and the first oil control valve hole;

a fourth oil passage that interconnects the first oil control valve hole and a first continuously variable valve timing apparatus;

a fifth oil passage that interconnects the second oil filter hole and the second oil control valve hole; and a sixth oil passage that interconnects the second oil control valve hole and a second continuously variable valve timing apparatus.

5. The cylinder head of claim 4, further comprising a seventh oil passage that interconnects the second oil passage to a timing chain tensioner.

* * * * *